United States Patent [19]

Slonaker et al.

[11] 4,151,943

[45] May 1, 1979

[54] STRAND GUIDE DEVICE

[75] Inventors: Robert O. Slonaker, Pataskala; John L. Patterson, Granville; Richard H. Pierce, Columbus, all of Ohio

[73] Assignee: Owens-Corning Fiberglas Corporation, Toledo, Ohio

[21] Appl. No.: 865,143

[22] Filed: Dec. 28, 1977

[51] Int. Cl.[2] ..... B65H 23/04

[52] U.S. Cl. ..... 226/91; 226/97; 226/109; 226/196; 242/157 R

[58] Field of Search ..... 226/91, 109, 110, 196, 226/199, 97; 242/157 R

[56] References Cited

U.S. PATENT DOCUMENTS 3,120,049 2/1964 Spurgeon ..... 226/109 X 3,734,374 4/1973 Perry ..... 226/199

*Primary Examiner*—Richard A. Schacher

*Attorney, Agent, or Firm*—Ronald C. Hudgens; Philip R. Cloutier; Paul J. Rose

[57] ABSTRACT

The strand guide device includes a generally vertical base plate, a pair of vertically spaced strand guide rolls secured to the base plate in cantilever fashion, and a generally vertical strand guide plate extending from the base plate parallel to and principally adjacent the upper one of the rolls and having a contoured upper edge defining a generally U-shaped strand guide portion adapted to confine moving strands and a slot portion inclined upwardly toward the strand guide portion and adapted to hold a stationary standby strand in readiness for insertion into a group of moving strands.

7 Claims, 5 Drawing Figures

STRAND GUIDE DEVICE

Figure 1:
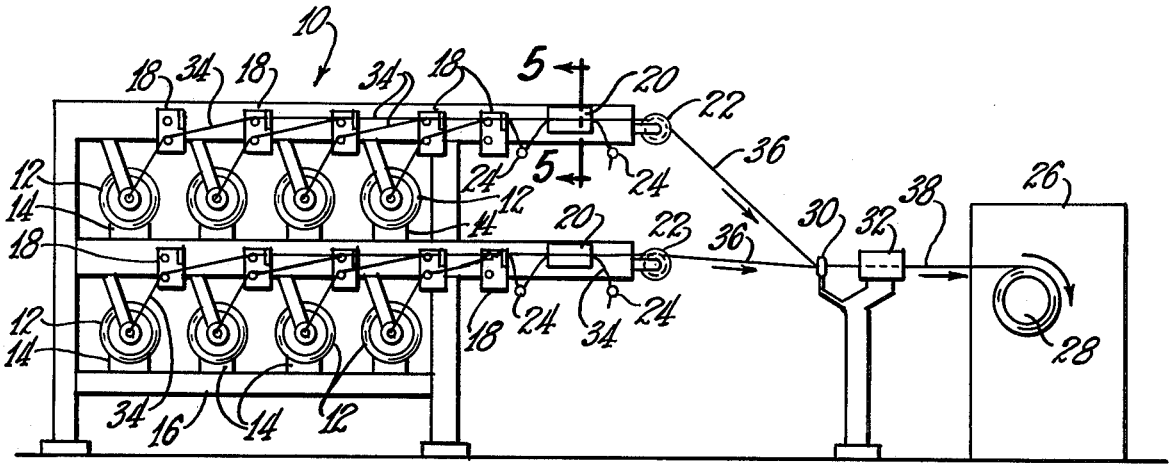

This invention relates generally to strand guide devices, and more particularly to a strand guide device useful in a roving process wherein several strands are combined into a multi-strand roving and one strand is always held in readiness to replace a broken strand or an exhausted strand supply.

An object of the invention is to provide an improved strand guide device for such a roving process.

Figure 3:
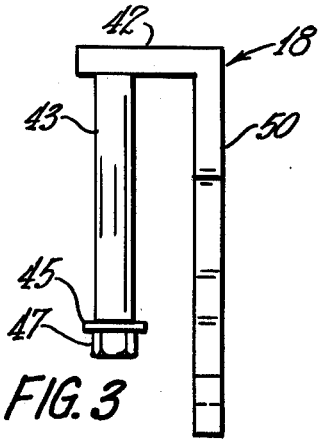
Figure 2:
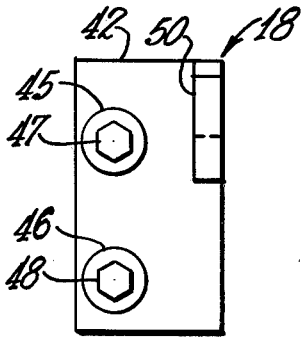
Figure 4:
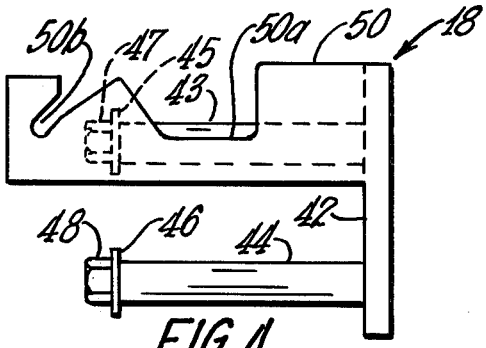
Figure 5:
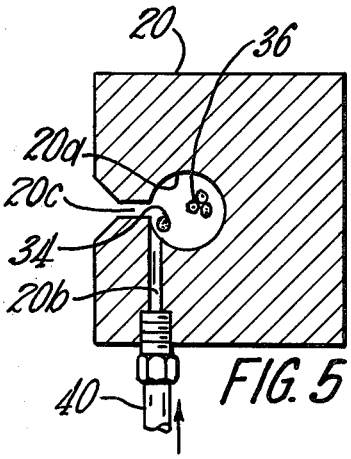

In the drawings,

FIG. 1 is an elevational view of apparatus for combining several strands into a multi-strand roving, the apparatus including a plurality of strand guide devices constructed in accordance with the invention;

FIGS. 2, 3, and 4 are end, plan, and side elevational views, respectively, of a strand guide device constructed in accordance with the invention; and FIG. 5 is a fragmentary sectional view taken generally along the line 5—5 of FIG. 1.

With respect to the drawings, In FIG. 1 a creel 10 is shown having eight strand supply packages 12 supported respectively in cradles 14 mounted in two tiers on a frame 16. Ten strand guide devices 18 constructed in accordance with the invention are suitably mounted on the frame 16 in two tiers of five. Each tier of strand guide devices 18 is provided with a strand inserter 20 and a guide pulley 22 suitably mounted on the frame 16. Further, each strand inserter 20 has a pair of strand holders 24 suitably mounted below and respectively on opposite sides thereof.

Associated with the creel 10 is a winder 26 having a rotatable collet 28. Between the creel 10 and winder 26 a guide eye 30 and a strand tensioning device 32 are suitably mounted.

Each package 12 supplies a strand 34 which, for example, may be a bundle of continuous glass filaments. In the example shown, in each tier of packages 12, three strands 34 are unwound advanced from their respective packages 12, grouped at the strand device 18 adjacent the strand inserter 20 into a three-strand group 36, and combined at the guide eye 30 with a three-strand group 36 from the other tier into a six-strand roving 38 being wound on the collet 28. The other strand 34 in each tier of packages 12 is resiliently held by the holders 24 as a stationary standby strand. If any of the three moving strands 34 in each tier of packages 12 breaks or its supply package 12 runs out, sensing and control means (not shown) causes compressed air to be released through a conduit 40 (FIG. 5) which feeds the air tangentially into a cylindrical chamber **20*a* of the strand inserter 20 through a passage 20*b*, causing the stationary standby strand 34 adjacent the inner end of the passage 20*b* to become entangled in the group 36 of moving strands and start moving therewith to take the place of the broken or exhausted strand. All the operator needs to do then is replace the exhausted package 12 with a full one and thread the strand 34 thereof on the proper strand guide devices 18 and through a slot 20*c* in the strand inserter 20, resiliently clamping the end in the holders 24**.

One of the strand guide devices 18 is shown in FIGS. 2–4 and includes a generally vertical base plate 42, a pair of vertically spaced strand guide rolls 43 and 44 provided respectively with end caps 45 and 46 and secured to the base plate 42 in cantilever fashion respectively by a pair of bolts 47 and 48 extending therethrough and threaded into the base plate 42, and a generally vertical strand guide plate 50 extending from the base plate 42 parallel to and principally adjacent the upper roll 43. If desired, the base plate 42 and the strand guide plate 50 may be molded in one piece. The plate 50 has a contoured upper edge defining a generally U-shaped strand guide portion **50*a* for moving strands 34 and a slot portion 50*b* inclined upwardly toward the strand guide portion and adapted to receive a stationary standby strand 34**.

As viewed in FIG. 1, each strand supply package 12 has a strand guide device 18 mounted upwardly and to the right thereof. A moving strand 34 from a package 12 passes over the lower roll 44 of the adjacent device 18 and then over the upper roll or rolls 43 of the succeeding device or devices 18. The rolls 43 and 44 are preferably made of a ceramic material called "ALSIMAG 193" produced by the Technical Ceramic Products Division of 3M Company in Laurens, South Carolina. In normal operation, the moving strands 34 do not contact the strand guide plate 50, because the lower edge of the strand guide portion **50*a* is below the upper extremity of the upper roll 43. Preferably the side of the strand guide portion 50*a* adjacent the slot 50*b* is upwardly inclined toward the slot. The stationary standby strand 34 passes over the lower roll 44 of the adjacent device 18 and is disposed in the slot 50*b* of one or more succeeding devices 18. Preferably the rollers 43 and 44 are chamfered at opposite ends and the end caps 45 and 46 and the base plate 42 are countersunk to receive the respective chamfered ends. In the description of the base plate 42 and the strand guide plate 50 as "vertical", the intended meaning is that the major surfaces thereof lie in vertical planes. In an alternative embodiment, the bolts 47 and 48 may be longer with end portions threaded into the frame 16** or into nuts associated therewith.

Various other modifications may be made in the structure shown and described without departing from the spirit and scope of the invention.

We claim:

1. A strand guide device comprising a generally vertical base plate, a pair of vertically spaced strand guide rolls secured to the base plate in cantilever fashion, and a generally vertical strand guide plate extending substantially perpendicularly from the base plate adjacent an upper one of the strand guide rolls and having a contoured upper edge defining a generally U-shaped strand guide portion adapted to confine moving strands and a slot portion inclined upwardly toward the strand guide portion and adapted to hold a stationary standby strand in readiness for insertion into a group of moving strands.

2. A strand guide device as claimed in claim 1 wherein a lower edge of the strand guide portion is below the upper extremity of the upper strand guide roll.

3. A strand guide device as claimed in claim 1 wherein a straight lower edge of the strand guide plate is above a lower one of the strand guide rolls.

4. A strand guide device as claimed in claim 1 wherein a side of the strand guide portion adjacent the slot portion is upwardly inclined toward the slot portion.

5. A strand guide device as claimed in claim 1 wherein the strand guide rolls are secured to the base plate respectively by a pair of bolts extending respectively therethrough.

6. A strand guide device as claimed in claim 1 including a pair of end caps of larger diameter than the strand guide rolls and disposed respectively adjacent end portions of the rolls opposite from the base plate.

7. A creel comprising a horizontal row of spaced strand guide devices as claimed in claim 1, a frame, and a horizontal row of spaced strand supply packages mounted on the frame, the strand guide devices being mounted on the frame above the strand supply packages in offset relationship thereto, a stationary strand from one of the packages being threaded over a lower one of the strand guide rolls of the adjacent strand guide device and through the slot portion of the strand guide plate of the next strand guide device and of any succeeding strand guide devices in the row, and a moving strand from each of the other packages being threaded over the lower one of the strand guide rolls of the adjacent strand guide device, over the upper one of the strand guide rolls of the next strand guide device, through the strand guide portion of the strand guide plate of said next strand guide device, and over the upper one of the strand guide rolls and through the strand guide portion of the strand guide plate of any succeeding strand guide devices in the row.

* * * * *